United States Patent [19]

Boffardi et al.

[11] Patent Number: 4,798,683

[45] Date of Patent: Jan. 17, 1989

[54] METHOD FOR CONTROLLING CORROSION USING MOLYBDATE COMPOSITIONS

[75] Inventors: Bennett P. Boffardi, Bethel Park; Susan P. Rey, Coraopolis, both of Pa.

[73] Assignee: Calgon Corporation, Pittsburgh, Pa.

[21] Appl. No.: 184,239

[22] Filed: Apr. 21, 1988

[51] Int. Cl.[4] ..... C23F 11/00

[52] U.S. Cl. ..... 252/389.54; 252/387.62; 252/391; 252/392; 252/394; 252/395; 252/396

[58] Field of Search ..... 252/389.54, 389.62, 252/391, 392, 394–396

[56] References Cited

U.S. PATENT DOCUMENTS 4,176,059 11/1979 Suzuki ..... 252/181 X
4,409,121 10/1983 Latos et al. ..... 252/389
4,440,721 4/1984 Wilson et al. ..... 252/389 A X
4,548,787 10/1985 Wilson et al. ..... 252/389 X
4,640,793 2/1987 Persiniski et al. ..... 252/697 X

*Primary Examiner*—Peter A. Nelson
*Attorney, Agent, or Firm*—W. C. Mitchell; M. C. Sudol, Jr.

[57] ABSTRACT

A method for inhibiting corrosion in aqueous systems comprising adding to the system being treated an effective amount of a composition comprising a molybdate ion source and a water-soluble component selected from polymaleic acid anhydride, amine adducts of polymaleic anhydride, maleic anhydride copolymers, carboxylic acid/sulfonic acid polymers, salts of the above-described polymers, phosphonates, phosphino carboxylic acids, polyphosphoric acid and esters of polyphosphoric acid.

2 Claims, No Drawings

METHOD FOR CONTROLLING CORROSION USING MOLYBDATE COMPOSITIONS

BACKGROUND OF THE INVENTION

The instant invention relates to a method for inhibiting the corrosion of metallic surfaces in contact with aqueous systems and to compositions for use in such a method, particularly where the water of the aqueous system is oxygen-bearing. More particularly, the present invention relates to the use of compositions comprising a combination of a molybdate ion surface and a component selected from the group consisting of water soluble polymers of polymaleic acid or anhydride and amine adducts thereof, maleic anhydride copolymers, water soluble polymers containing a sulphonic acid and carboxylic acid moiety, salts of the above-described polymers, phosphonates, phosphino carboxylic acids, polyphosphoric acid and glycol esters of polyphosphoric acid, to inhibit the corrosion of metallic surfaces of water-carrying systems.

The term "aqueous system" as used herein, is intended to describe any system which contains water in any physical state, including water which contains one or more dissolved or dispersed substances such as inoroganic salts.

The term "metallic" as used herein, is intended to include ferrous and ferrous-containing materials.

The corrosion of a metallic surface in an aqueous system consists of the destruction of the ferrous metal by chemical or electrochemical reaction of the metal with its immediate environment.

Where the corrosion is electrochemical in nature, a transfer or exchange of electrons is necessary for the corrosion reaction to proceed. When corrosion of the metal takes place, at least two electrochemical processes occur, and must occur, simultaneously. There is an anodic oxidation reaction in which metal ions go into solution, leaving behind electrons; and at least one cathodic reduction reaction in which species in solution are reduced by consuming the electrons produced by the anodic reaction. With respect to ferrous or ferrous containing materials, when the water contains oxygen and is at a neutral pH or above, these processes may be illustrated by the following equations:

Anodic oxidation:

$$Fe \rightarrow Fe^{+2} + 2e^-$$

Cathodic reaction:

$$2H_2O + O_2 + 4e^- \rightarrow 4OH^-$$

The two ionic reaction products, ferrous ion and hydroxyl ion, combine to form ferrous hydroxide, $Fe(OH)_2$, whichis then oxidized to form ferric hydroxide, $Fe(OH)_3$ (rust). For ferrous or ferrous-containing materials as well as other metals in aqueous systems, the principle factors influencing the corrosion process are the characteristics of the water in the system, including but not limited to the rate of water flow, the temperature of the system and contact between dissimilar metals in the system. Variable characteristics of the water which impact upon its corrosiveness are its dissolved oxygen concentration, carbon dioxide contant, pH and hardness.

The presence of dissolved oxygen in the water of an aqueous system is primarily the result of contact between the water and the atmosphere. The oxygen solubility in water is temperature and pressure dependent, with increases in pressure increasing solubility and increases in temperature lowering oxygen solubility.

Corrosion produced by the presence of oxygen in the water of an aqueous can take place in the form of small pits or depressions and/or in the form of general metal loss. As a corrosive process continues, pits or depressions generally increase in depth. The corrosive attack is more severe when it causes pits or depressions, since the deeper penetration of the metal causes more rapid failure at these points.

DESCRIPTION OF THE PRIOR ART

Polymaleic anhydride and copolymers and derivatives thereof have been employed as scale control agents. See, for example, U.S. Pat. Nos. 2,723,956; 3,289,734; 3,292,152; 3,578,589; and 3,715,307.

A variety of compositions have been employed in the art for the purpose of inhibiting corrosion of surfaces in water-carrying systems where the cause of corrosion is dissolved oxygen. Polyphosphates such as sodium tripolyphosphate are widely used in the treatment of once-thru systems. See U.S. Pat. No. 2,742,369. Silicates, for example sodium silicate, have also found acceptance.

U.S. Pat. No. 3,483,133 discloses a corrosion inhibiting composition comprising amino-tris(methylene phosphonic) acid compounds in combination with water soluble zinc salts. U.S. Pat. No. 3,762,873 discloses a corrosion inhibiting method using substituted succinimides. Canadian Pat. No. 854,151 discloses a composition and method for inhibiting corrosion and/or the formation of calcium and magnesium containing scales wherein a combination of organophosphonic acid compounds and water soluble polymers having carboxyl or amide groups is employed.

U.S. Pat. No. 3,810,834 discloses a method of treating the water of an aqueous system with hydrolyzed polymaleic anhydride having a molecular weight of 300 to 5,000 for the purpose of inhibiting scale formation, and U.S. Pat. Nos. 3,897,209; 3,963,636; and 4,089,796 disclose the use of the same hydrolyzed polymaleic anhydride material in combination with a zinc salt for the purpose of inhibiting both corrosion and scale formation.

U.S. Pat. No. 3,965,027 discloses certain amine adducts of polymaleic anhydride for use as scale and corrosion inhibitors.

U.S. Pat. No. 4,176,059 discloses the use of compositions comprising molybdates, organic cationic or nonionic surfactants, a water-soluble polyphosphate and a triazole for corrosion inhibition. U.S. Pat. No. 4,217,216 discloses a corrosion inhibiting composition comprising a azole, a molybdate and at least one aminomethylene phosphonic or derivative thereof. U.S. Pat. No. 4,246,030 discloses corrosion inhibiting compositions comprising a water-soluble carboxylic polymer and/or salt thereof and amino alkylene phosphonic acid or a derivative thereof, a water-soluble polymeric dispersing agent and other inhibitors such as molybdates, azoles, and various inorganic metal compounds.

U.S. Pat. No. 4,675,158 discloses mercaptobenzothiazole/tolyltriazole corrosion inhibiting compositions, and U.S. Pat. No. 4,668,474 discloses the use of mercaptobenzothiazole in combination with a ferrous ion source as corrosion control compositions.

U.S. Pat. No. 4,640,793 discloses synergistic scale and corrosion inhibiting admixtures containing carboxylic acid/sulphonic acid polymers and molybdates. U.S. Pat. No. 4,618,448 discloses the use of carboxylic/sulphonic/polyalkylene oxide polymers for use as scale and corrosion inhibitors.

However, none of the prior art references described above in any way suggest the synergistic results obtained with the novel compositions of the instant invention.

SUMMARY OF THE INVENTION

The method of the instant invention for inhibiting corrosion in an aqueous system comprises the step of treating an aqueous system with an effective amount of a composition comprising a molybdate ion source and a water-soluble component selected from the group consisting of water-soluble polymers of maleic acid or anhydride and amine adducts thereof water soluble maleic acid copolymers, water-soluble polymers containing sulphonic acid and carboxylic acid moieties, salts of the above-described polymers, phosphonates, phosphino carboxylic acids, polyphosphoric acid and water soluble esters of polyphosphoric acid.

The weight ratio of the molybdate ion source to the second component may range from 100:1 to 1:100, preferably about 10:1 to about 1:10. The corrosion inhibiting compositions of this invention may optionally contain other known corrosion inhibitors, such as zinc salts, triazoles or an ortho-phosphate source.

The present invention also concerns the novel compositions used in the method of the present invention for inhibiting corrosion.

The instant compositions are especially effective over a pH range of from about 6.0 to about 9.0, preferably about 7.0 to about 8.0, and these compositions are effective in waters of various hardness.

DETAILED DESCRIPTION OF THE INVENTION

The invention invention is directed to a method for inhibiting corrosion in an aqueous system comprising adding to said system an effective amount of a corrosion inhibiting composition comprising:

(a) a molybdate ion source; and (b) a water-soluble component selected from the group consisting of polymaleic anhydride, amine adducts of polymaleic anhydride, polymers prepared by polymerizing maleic anhydride with dimethyl diallyl ammonium chloride or homologs thereof, polymers containing carboxylic acid and sulphonic acid moieties, salts of the above-described polymers, phosphonates, phosphino carboxylic acids, polyphosphoric acid and glycol esters of polyphosphoric acid.

Any source of molybdate ions can be used. The preferred sources are water soluble molybdate salts, and the most preferred molybdate salts are magnesium molybdate, ammonium molybdate and alkali metal molybdates such as lithium molybdate, sodium molybdate and potassium molybdate.

The polymaleic anhydride material employed in the compositions of the present invention may be prepared by a number of different polymerization methods well-known in the art. Since polymaleic anhydride may be hydrolyzed very readily, for example, by heating with water, to form a polymer which contains free carboxylic acid groups and possibly some residual anhydride groups on a carbon back, the term polymaleic anhydride as used in this specification includes the polymeric product formed by hydrolyzing polymerized maleic anhydride.

The preferred maleic anhydride polymer employed in the compositions of the present invention should have a weight average molecular weight of from about 200 to about 10,000, preferably from about 200 to about 5,000.

Since polymerized maleic anhydride is so readily hydrolyzed, treatment of water in an aqueous system with polymerized maleic anhydride is the same as treating with hydrolyzed polymaleic anhydride, i.e., polymaleic acid. Consequently, the present invention includes the use of such proportion of polymerized maleic anhydride as will yield the desired amount of hydrolyzed polymaleic anhydride on hydrolysis.

In addition to or instead of the polymaleic anhydrides employed in the compositions and method of the present invention one may use amine adducts of polymaleic anhydride selected from the group consisting of:

(a) polymers having recurring units of the formula:

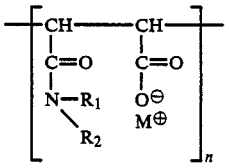

wherein M⊕ may be H⊕, alkaline metal cation, or quaternary ammonium cationic formula:

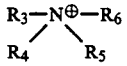

wherein for all of the above formulas, $R_1$, $R_2$, $R^3$, RHU 4, $R^5$, and $R^6$ are each independently selected from the group consisting of hydrogen, alkyl or from 1 to 10 carbon atoms, and substituted alkyl from 1 to 10 carbon atoms where the substituent is hydroxyl; carbon and carboxylic acid groups, and alkaline metal ion and ammonium salts thereof; and wherein N is an integer of from 2 to 100; also, $O^-$ and $M^+$ may be replaced by —COOH, to form acid amides; and (b) polymers having recurring units of the formula

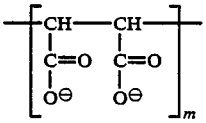

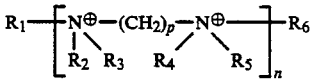

wherein $R_1$, $R_2$, $R_3$, $R_4$, $R_5$ and $R_6$ are each independently selected from the group consisting of hydrogen, alkyl from 1 to 10 carbon atoms and substituted alkyl from 1 to 10 carbon atoms, where the substituent is hydroxyl; carbonyl; and carboxylic acid groups, and alkali metal ion and ammonium salts thereof; wherein P is an integer from 1 to 6; wherein N is an integer from 2 to 100; and wherein M is an integer from 2 to about 100, provided that, M not equal to N, the lesser of M or N is multiplied by a factor such that N equals M.

Representative examples of the polymaleic anhydride amine adduct polymer compositions useful in the instant method and compositions include, but are not limited to, the mono-amido ammonium salt of polymaleic anhydride; polymaleic anhydride sodium iminodiacetate; polymaleic anhydride ethanol amine adduct; polymaleic anhydride diethanolamine adduct; and polymaleic acid N, N, N', N'-tetramethyldiaminoethane ammonium salt.

The amine adducts of polymaleic anhydride are preferably low molecular weight polymers having a weight average molecular weight of from about 200 to about 10,000. These polymers compositions are water soluble, and their salts may also be used, for example, the alkaline metal or ammonium salts thereof. The makeup of these polymer compositions with respect to the proportionate amounts of the constituent maleic anhydride amine groups present in the polymer chain may vary such that the mole ratio of amine to maleic anhydride groups may be from about 0.1 to about 2.0.

While polymaleic anhydride is itself not soluble in water until hydrolyzed to the acid form, the amine adducts of polymaleic anhydride are water soluble. Thus, they are readily introduced into an aqueous system to be treated in any suitable manner known in the art. Polymaleic anhydride amine adducts employed in the compositions of the present invention may be prepared in accordance with the procedures described in U.S. Pat. No. 3,965,027, which is hereby incorporated into this specification by reference.

The polymers of maleic anhydride which may be used as component (b) include polymers prepared by polymerizing maleic anhydride with other monomers. For example, polymers prepared by polymerizing maleic anhydride in combination with dimethyldiallyl ammonium chloride, or a homolog thereof, are useful in the instant compositions. Homologs of dimethyldiallyl ammonium chloride (DMDAAC) include diethyldiallyl ammonium chloride (DEDAAC), dimethyldiallyl ammonium bromide (DMDAAB) and diethyldiallyl ammonium bromide (DEDAAB). The ratio of maleic anhydride to the quaternary ammonium moiety in such polymers, on a weight basis, should range from about 10:1 to 1:10 preferably from about 3:1 to about 1:1. The molecular weight of such polymers should range from about 200 to about 500,000, preferably from about 500 to about 10,000. Water-soluble salts of these polymers can also be used. Such polymers can be prepared by free-radical polymerization techniques, preferably in an aqueous solution using a persulfate-type initiator.

The carboxylic/sulfonic polymer of the instant invention may be any water soluble polymer having an intrinsic visocosity of 0.05 to 2.5 dl/g prepared from:

(a) 40 to 95%, by weight, of an unsaturated carboxylic compound selected from the group consisting of acrylic acid, methacrylic acid, maleic acid, itaconic acid, their salts and mixtures thereof;

(b) 5 to 60%, by weight, of an unsaturated sulfonic compound selected from the group consisting of 2-acrylamido-2-methylpropylsulfonic acid, 2-methacrylamido-2-methylpropylsulfonic acid, methallylsulfonic acid, allylsulfonic acid, vinyl sulfonic acid, styrene sulfonic acid, their salts and mixtures thereof; and (c) 0 to 40%, by weight, of an unsaturated polyalkylene oxide compound.

While carboxylic acid/sulfonic acid copolymers may be used, an unsaturated polyalkylene oxide moiety is preferably present. Examples of suitable monomers include allyl polyethylene glycols, methallyl polyethylene glycols, polyethylene glycol acrylates, polyethylene glycol methacrylates, methoxy allyl polyethylene oxides, alloxyallyl polyethylene oxides and the polypropylene equivalents thereof. Also, mixtures of polyethers formed from polyethylene oxide with other polyalkylene oxides, such as propylene or butylene oxide, may be used. The polyether chain may be capped with an alkyl, aralkyl, sulfonate or phosphonate group metal or ion, or it may be uncapped.

The preferred polyalkylene oxides are polyethylene glycol methacrylates containing up to about 20 ($OCH_2CH_2$) groups, most preferably 3–10 ($OCH_2CH_2$) groups.

Also, other monomers may be used. For example, non-ionic monomers such as acrylamide, methacrylamide and acrylonitrile may also be present in the polymers.

The most preferred carboxylic/sulfonic polymers of the instant invention are prepared by polymerizing 50–70%, by weight, of an unsaturated carboxylic acid or salt; 10 to 40%, by weight, an unsaturated sulfonic acid or salt; 10 to 30%, by weight, of an unsaturated polyalkylene oxide compound. The most preferred carboxylic acids are acrylic acid and methacrylic acid, the most preferred sulfonic acid are 2-acrylamido-2-methylpropylsulfonic acid and 2-methacrylamido-2-methylpropylsulfonic acid, and the most preferred polyalkylene oxides are polyethylene glycol methacrylates.

These polymers may be prepared by mixing the monomers in the presence of a free radical initiator. Theoretically, any free radical initiator may be used. Examples of preferred initiators include peroxides, azo initiators and redox systems. The polymerization may also be initiated photochemically. The preferred catalysts are sodium persulfate and sodium metabisulfite. The polymerization may be conducted by any of a variety of procedures, for example, in solution, suspension, bulk or emulsion.

Polymers of this type are usually characterized by intrinsic viscosity. The intrinsic viscosity should be 0.05 to 2.5, preferable 0.05 to 0.5 dl/g, in 1.0M sodium chloride (measured on a 75 Cannon Ubbelohde capillary viscometer). Water soluble salts may also be used.

Phosphonates may be used as component (b). The preferred phosphonates are 2-phosphonobutane-1,2,4 tricarboxylic acid and hydroxyphosphino acetic acid. Phosphino carboxylic acids may also be used.

The polyphosphoric acid of the instant invention is an equilibrium mixture of orthophosphoric acid, pyrophosphoric acid and higher linear polyphosphoric acid and is commercially available from FMC Corporation. Polyhydroxy alcohol esters of polyphosphoric acid may also be used as component (b). The preferred polyhydroxy alcohol esters are glycol esters and pentaerythritol esters. Such esters are available from Calgon Corporation as Conductor 5712.

The ratio of component (a) to component (b) in the instant compositions may range from about 1:10 to about 10:1, on an active weight basis, preferably from 5.1 to about 1.5. An effective amount of the instant compositions should be used. As used herein, the term "effective amount" refers to that amount which inhibits or prevents the corrosion of metallic surfaces in contact with the aqueous system being treated. Preferably, the instant compositions should be added at a dosage of from about 0.1 to about 200 ppm, on an active weight basis, based on the total weight of the water in the aqueous system being treated. Components (a) and (b) can be added separately or in combination, which ever is most convenient.

The instant method is especially effective at pH's ranging from about 6.0 to about 9.0, preferably from about 7.0 to about 8.0. Also, the instant method is effective at various levels of hardness.

Other known corrosion inhibitors, such as zinc salts or azoles, may be used in conjunction with the instant compositions,

EXAMPLES

The following examples further illustrate this invention. However, they are not intended to limit the scope of this invention in any way.

Corrosion studies were initiated by precleaning 1"×2" carbon steel coupons with xylene, Calclean, (an alkaline silicate phosphate cleaner available from Calgon Corporation), water and acetone, respectively in an ultrasonic bath, then drying them with house air. The coupons were weighed and then hung in eight liter test solutions which were adjusted to and maintained at pH 7.0 or 8.0, heated to and maintained at 50° C., circulated and aerated. Three test solutions of varying hardness were used.

Soft water was prepared by adding 1.40 L of 4X Pittsburgh water to 6.60 L of deionized water. 4X Pittsburgh water is a solution of 50.2 mg/L $MgCl_2.6H_2O$, 43.2 mg/L $Na_2SO_4$, 13.8 mg/L $NaHCO_3$ and 379.5 mg/L $CaSO_4.2H_2O$. Moderately hard water was prepared by adding 7.30 L of 4X Pittsburgh water to 0.70 L of deionized water. Hard water was prepared by adding 43.26 grams of 50.0 g/L $CaCL_2.2H_2O$ to 8.0 L of 4X Pittsburgh water.

Inhibitor stock solutions were made up at an active concentration of 8.0 g/L and were added individually to the various test solutions before coupon immersion. The $MoO_4^{-2}$ source in all tests was $Na_2MoO_4.2H_2O$. For tests at pH 8.0, 15 mLs of an 8.0 g/L active solution of an acrylic acid/acrylamidosulfonic acid/polyalkylene oxide inhibitor was added to each test solution, in addition to the inhibitor stock solution, to prevent $Ca^{+2}/MoO_4^{-2}$ and/or $Ca^{+2}/PO_4^{-3}$ precipitation. Fifteen inhibitors were tested, including:

1. AMP (aminotris(phosphoric acid));
2. HEDP (hydroxyethylidene diphosphonic acid);
3. Ortho-phosphate;
4. Sodium hexametaphosphonate (sold as Calgon ® by Calgon Corporation);
5. Bayhibit (2-phosphonobutanetricarboxylic acid-1,2,4, commercially available from Mobay);
6. PMA (polymaleic anhydride having a MW of approximately 1300);
7. Belsperse 161 (polymeric phosphino carboxylic acid, commercially available from Ciba Geigy);
8. Belcor 575 (2-hydroxyphosphonoacetic acid, commercially available from Ciba Geigy);
9. Conductor 5712 (3% pentaerythritol ester of polyphosphoric acid, 15% polyphosphoric acid and 3% o-phosphate (weight basis), commercially available from Calgon Corporation);
10. $Zn^{+2}$;
11. Verchem 110 (low molecular weight polyDMDAAC, commercially available from Calgon Corporation having a molecular weight of 3000–4000);
12. *2:1 MA/DMDAAC (2:1, by weight, maleic anhydride/dimethyldiallyl ammonium chloride polymer, available from Calgon Corporation);
13. *1:1 MA/DMDAAC (1:1, by weight, maleic anhydride/dimethyl diallyl ammonium chloride polymer, available from Calgon Corporation);
14. Tolyltriazole; and
15. a 70/20/10 AA/AMPSA/polyethylene glycol methacrylate terpolymer prepared using 70%, by weight, acrylic acid; 20%, by weight, 2-acrylamido-2-methylpropylsulfonic acid and 10%, by weight, $CH_2=C_2H_4—CO—(OCH_2CH_2)_n$ OH where n=5, having a molecular weight of approximately 10,000.

*The maleic acid/DMDAAC polymers were prepared by mixing maleic anhydride and DMDAAC monomer in deionized water at the desired ratio. After adjusting the pH to 6.0, sodium persulfate was added as an initiator at 6.4 mole %, based on total monomers. The initiator system was fed to the monomer solution over four (4) hours at a temperature of 100° C. These polymers have molecular weights of about 1500–3000.

After seven days, coupons were removed and cleaned with inhibited acid, water and acetone, respectively in an ultrasonic bath. Inhibited acid contains 50.0 g $SnCl_2$ and 20.0 g $Sb_2O_3$ per liter of 1:1 HCl. Coupons were then dried using house air and reweighed. From the coupon weight losses, the corrosion rates in mpy were calculated.

The results are shown in Table 1. Table 2 presents the results of Table 1 in "% inhibition" format.

TABLE 1

Corrosion Rates for $MoO_4^{-2}$ Formulations Under Varying Conditions (mpy)

| Treatment | Active Concentration (mg/L) | pH 7.0 Hard | pH 7.0 Moderate | pH 7.0 Soft | pH 8.0* Hard | pH 8.0* Moderate | pH 8.0* Soft |
|---|---|---|---|---|---|---|---|
| Control | — | 89 | 70 | 76 | 55 | 56 | 77 |
| $MoO_4^{-2}$/AMP | 15/15 | 24 | 28 | 8 | 4 | 3 | 1 |
| $MoO_4^{-2}$/HEDP | 15/15 | 32 | 29 | 5 | 23 | 7 | 3 |
| $MoO_4^{-2}/PO_4^{-3}$ | 15/15 | 6* | 7 | 6 | 1 | 1 | 1 |
| $MoO_4^{-2}$/Calgon | 15/15 | 12 | 21 | 5 | 1 | 1 | 2 |
| $MoO_4^{-2}$/Bayhibit | 15/15 | 46 | 31 | 5 | 20 | 31 | 2 |
| $MoO_4^{-2}$/PMA | 15/15 | 54 | 61 | 6 | 43 | 40 | 2 |
| $MoO_4^{-2}$/ Belsperse 161 | 15/15 | 123 | 68 | 4 | 49 | 51 | 3 |
| $MoO_4^{-2}$/ Belcor 575 | 15/15 | 2 | 3 | 4 | 4 | 2 | 1 |
| $MoO_4^{-2}$/ Conductor 5712 | 15/15 | 4 | 0.7 | 2 | 1 | 2 | 0.3 |
| $MoO_4^{-2}/Zn^{+2}$ | 50/5.0 | 100 | 80 | 20 | 61 | 43 | 1 |
| $MoO_4^{-2}$/ Verchem 110 | 15/15 | 91 | 69 | 69 | 63* | 55* | 77* |
| $MoO_4^{-2}$/ 2:1 MA/DMDAAC | 15/15 | 70 | 80 | 87 | 40 | 64 | 3 |
| $MoO_4^{-2}$/ 1:1 MA/DMDAAC | 15/15 | 66 | 79 | 76 | 38 | 66 | 5 |

TABLE 1-continued

Corrosion Rates for $MoO_4^{-2}$ Formulations Under Varying Conditions (mpy)

| Treatment | Active Concentration (mg/L) | pH 7.0 Hard | pH 7.0 Moderate | pH 7.0 Soft | pH 8.0* Hard | pH 8.0* Moderate | pH 8.0* Soft |
|---|---|---|---|---|---|---|---|
| $MoO_4^{-2}$/ Tolyltriazole | 50/5.0 | 79 | 109 | 51 | 82** | 95** | 57** |
| $MoO_4^{-2}$ | 15.0 | 74 | 66 | 70 | 37 | 73 | 68 |
| 70/20/10 AA/ AMPSA/Methoxy allyl PEG | 15.0 | — | — | 40 | — | — | 60 |
| $MoO_4^{-2}$/70/20/10 AA/AMPSA/methoxy allyl PEG | 15.0/15.0 | — | — | 2.1 | 57 | 70 | 2.4 |
| Control | — | 89 | 70 | 76 | 55 | 56 | 77 |

*Additional 15 mg/L of active 70/20/10 acrylic acid/acrylamido methyl propyl/Sulfonic acid/methoxy allyl PEG (TRC-271, available from Calgon) was added, except where shown by**

TABLE 2

| | Active Concentration (mg/L) | pH 7.0 % Inhibition Predicted | pH 7.0 % Inhibition Actual | pH 8.0 % Inhibition Predicted | pH 8.0 % Inhibition Actual |
|---|---|---|---|---|---|
| $MoO_4^{-2}$ | 15 | — | 8 | — | 12 |
| Calgon | 15 | — | 61 | — | 30 |
| Bayhibit | 15 | — | 64 | — | 49 |
| PMA | 15 | — | 34 | — | 34 |
| Belsperse 161 | 15 | — | 39 | — | 30 |
| Conductor 5712 | 15 | — | 97 | — | 86 |
| 2:1 MA:DMDAAC | 15 | — | 25 | — | 23 |
| 70/20/10 AA/AMPSA/ methoxy allyl/PEG | 15 | — | 47 | — | 22 |
| $MoO_4^{-2}$/Calgon | 15/15 | 69 | 98 | 73* | 97* |
| $MoO_4^{-2}$/Bayhibit | 15/15 | 72 | 93 | 83* | 97* |
| $MoO_4^{-2}$/PMA | 15/15 | 42 | 92 | 68* | 97* |
| $MoO_4^{-2}$/ Belsperse 161 | 15/15 | 47 | 95 | 64* | 96* |
| $MoO_4^{-2}$/ 2:1 MA:DMDAAC | 15/15 | 33 | 14 | 57* | 97* |
| $MoO_4^{-2}$/70/20/10 AA/AMPSA/methoxy allyl PEG | 15/15 | 55 | 97 | 34 | 97 |

*Additional 15 mg/L of Active TRC-271.
% Inhibition Predicted = Σ % Inhibition Formulation Components

What is claimed is:

1. A method for inhibiting corrosion in an aqueous system comprising adding to said system an effective amount of a corrosion inhibiting composition comprising:

(a) a molybdate ion source; and (b) a water-soluble component selected from the group consisting of polymaleic anhydride; amine adducts of polymaleic anhydride; polymers prepared by polymerizing maleic anhydride with dimethyl diallyl ammonium chloride or homologs thereof; polymers prepared from 50–70%, by weight, acrylic acid or methacrylic acid, 10–40%, by weight, 2-acrylamido-2-methylpropyl sulfonic acid or 2-methyacrylamido-2-methylpropyl sulfonic acid and 10–30%, by weight, of a polyalkyleneoxide compound; salts of the above described polymers; phosphonates selected from the group consisting of 2-phosnphonobutane-1,2,4 tricarboxylic acid and hydroxyphosphono acetic acid; phosphino carboxylic acids; polyphosphoric acid and polyhydroxy esters of polyphosphoric acid; wherein the weight of (a):(b), on an active basis, ranges from about 10:1 to about 1:10.

2. A composition comprising:

(a) a molybdate ion source; and (b) a water-soluble component selected from the group consisting of polymaleic anhydride; amine adducts of polymaleic anydride; polymers prepared by polymerizing maleic anhydride with dimethyl diallyl ammonium chloride or homologs thereof; polymers prepared from 50–70%, by weight, acrylic acid or methacrylic acid, 10–40%, by weight, 2-acrylamido-2-methylpropyl sulfonic acid or 2-methyacrylamido-2-methylpropyl sulfonic acid and 10–30%, by weight, of a polyalkyleneoxide compound; salts of the above described polymers; phosphonates selected from the group consisting of 2-phosphonobutane-1,2,4 tricarboxylic acid and hydroxyphosphono acetic acid; phosphino carboxylic acids; polyphosphoric acid and polyhydroxy esters of polyphosphoric acid; wherein the weight of (a):(b), on an active basis, ranges from about 10:1 to about 1:10.

* * * * *